United States Patent [19]

Richert

[11] 4,286,801

[45] Sep. 1, 1981

[54] SAFETY TOE UNIT FOR A SKI BINDING

[75] Inventor: Manfred Richert, Farchant, Fed. Rep. of Germany

[73] Assignee: Vereinigte Baubeschlagfabriken Gretsch & Co. GmbH, Fed. Rep. of Germany

[21] Appl. No.: 114,590

[22] Filed: Jan. 23, 1980

[30] Foreign Application Priority Data

Feb. 7, 1979 [DE] Fed. Rep. of Germany ..... 2904660

[51] Int. Cl.[3] ..... A63C 9/08

[52] U.S. Cl. ..... 280/629; 280/623; 280/630

[58] Field of Search ..... 280/629, 630, 628, 627, 280/625, 624, 623, 626, 611

[56] References Cited

U.S. PATENT DOCUMENTS

| | | | |
|---|---|---|---|
| 2,994,543 | 8/1961 | Hvam | 280/630 |
| 3,840,240 | 10/1974 | Covini | 280/629 |
| 3,902,728 | 9/1975 | Salomon | 280/629 |
| 4,087,114 | 5/1978 | Csosz | 280/629 |

FOREIGN PATENT DOCUMENTS

| | | | |
|---|---|---|---|
| 2259916 | 9/1973 | Fed. Rep. of Germany | 280/629 |
| 2359490 | 6/1974 | Fed. Rep. of Germany | 280/629 |
| 2558339 | 7/1977 | Fed. Rep. of Germany | 280/629 |

*Primary Examiner*—Joseph F. Peters, Jr.
*Assistant Examiner*—Milton L. Smith

[57] ABSTRACT

A safety toe unit for a ski binding features a toe clamp 14 attached via a pivot pin 11 to a draw rod 12 which draws the toe clamp under the effects of a bias spring 23 against a binding housing 22. Complementary pairs of abutment features are provided on the binding housing and the toe clamp to either side of the draw rod and define respective pivot axes about which the toe clamp can pivot to effect a sideways release. The arrangement features an adjustment screw 13 which cooperates with a screw-threaded intermediate member 19 located on the end of the draw rod 12 to effect vertical adjustment of the toe clamp. The arrangement enables the use of a one-piece toe clamp without the adjustment screw being subjected to the load of the bias spring 23. In modifications the adjustment screw cooperates with screw threads provided either at the end of the draw rod or on the pivot pin and the pivot pin can be slidably or fixedly connected into the end of the draw rod.

12 Claims, 6 Drawing Figures

SAFETY TOE UNIT FOR A SKI BINDING

Figure 1:
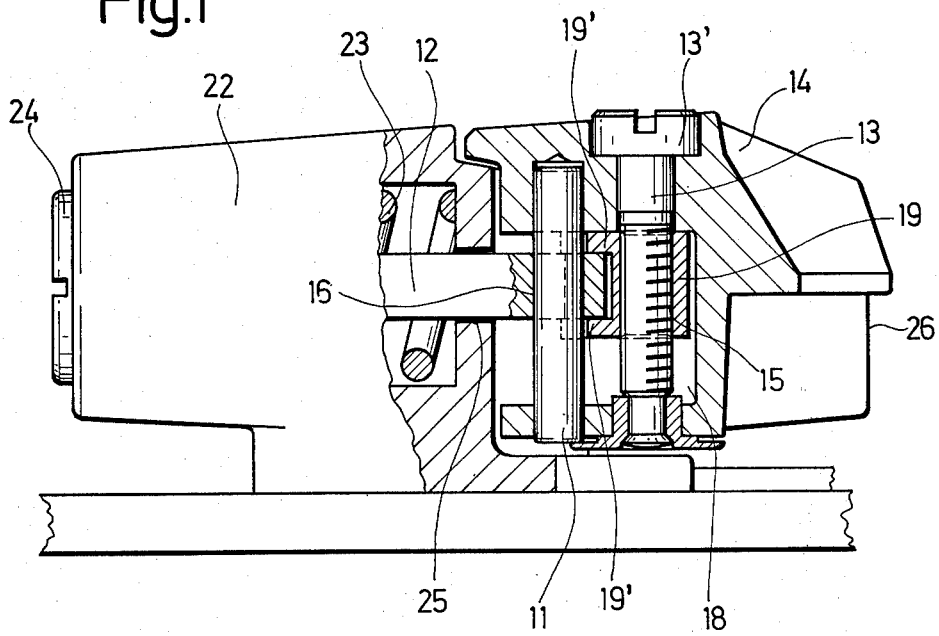

The present invention relates to a safety toe unit for a ski binding and has particular reference to a safety toe unit of the kind in which a toe clamp, for securing the toe portion of a ski boot to a ski, is drawn by a spring biased draw rod against a relatively fixed housing part and is able to pivot sideways to the left or to the right about respective axes disposed on either side of the draw rod and defined by complementary abutment features on the binding housing and the toe clamp.

In an arrangement of this kind a pivotally journalled adjustment screw is usually provided at the toe clamp to allow vertical adjustment of the toe clamp and the draw rod passes through an aperture in the binding housing which locates the draw rod in the vertical direction but which allows movement thereof in the sideways direction to accomodate the sideways movement of the draw rod which necessarily accompanies sideways pivoting movement of the toe clamp. It will be understood that when the toe clamp pivots to one side about the pivot axis defined by one pair of the complementary abutment features then, of necessity, the other pair of complementary abutment features defining the other pivot axis on the other side of the toe clamp necessarily separate.

One known safety toe unit of this kind in which the toe clamp can pivot sideways against the spring bias so as to release the ski boot in the event of a fall, is shown in German Auslegeschrift 2 259 916. In this arrangement adjustment of the vertical position of the toe clamp by rotation of the adjustment screw results in vertical movement of the front end of the draw rod. The adjustment screw is arranged in a vertically threaded bore of the toe clamp and must be guided within recesses in the housing to accommodate the movement of the adjustment screw associated with the joint pivotal movement of the toe clamp and the draw rod which occurs on adjustment of the vertical position of the toe clamp. The size of the recesses must correspond with the range of vertical pivotal movement of the draw rod and toe clamp. This arrangement not only presents constructional difficulties but rather also results in the release force being disadvantageously affected by jamming which can occur between the adjustment screw and the housing. Furthermore, the end of the draw rod adjacent the ski boot must be displaceable in the vertical direction by an amount corresponding to the required vertical range of adjustment of the toe clamp and this can result in undesired stresses within the mechanism as a result of the kinematics thereof.

It is also known from German Offenlegungsschrift 2 359 490 to simultaneously use the threaded adjustment screw as the pivot pin for connecting the toe clamp with the draw rod. This, however, brings the disadvantage that the threaded adjustment screw is continuously subjected to the force of the release spring. As a result the threads are subject to an increased degree of wear and, as a consequence of the relative movement between the spring biased draw rod and the vertical adjustment screw, selfadjustment of the vertical adjustment mechanism cannot be precluded.

Finally it is also known from German Offenlegungsschrift 2 558 339 to make the toe clamp in two parts in which the one toe clamp part is pivotably connected to the rear end of the draw rod while the part of the toe clamp which engages the ski boot can be adjusted vertically relative to the other part via the threaded adjustment screw. In this way the screw-threaded bolt is indeed no longer subjected to the release forces, however, the two-part construction of the toe clamp is expensive and complicated from the points of view of manufacture and assembly in particular in relation to the range of adjustment of the toe clamp part which engages the ski shoe in relation to the part which carries the complementary abutment features.

The principal object underlying the present invention is to provide an improved safety toe unit of the kind generally described above which is of simple construction, which is favorable from the points of view of manufacture, construction and cost and in which the adjustment screw is not subjected to the forces of the release mechanism.

In order to accomplish this task the present invention envisages a safety toe unit for a ski binding having the following features: a binding housing for fastening to a ski, a toe clamp disposed at the rear of the housing and adapted to locate the toe portion of a ski boot, a vertically extending freely rotatable but axially located adjustment screw carried by said toe clamp for adjusting the vertical height thereof, spring means adapted to draw the toe clamp against the housing via a draw rod disposed within the housing and extending through an opening therein, said opening being sized to locate the draw rod in the vertical direction but to permit sideways movement thereof, a first pair of complementary abutment surfaces provided between the toe clamp and the housing and located to one side of the draw rod, a second pair of complementary abutment surfaces provided between the toe clamp and the housing and located to the other side of the draw rod, said first and second pairs of complementary abutment surfaces defining respective first and second pivot axes respectively enabling sideways pivotal movement of the sole clamp to a respective side of the housing with simultaneous separation of the pair of complementary abutment surfaces defining the other of said pivot axes and simultaneous movement of said draw rod, there being further provided a pivot pin arranged parallel to said adjustment screw and directly pivotally connecting said toe clamp to said draw rod, said pivot pin being vertically displaceable relative to one of said toe clamp and said draw bar, and said adjustment screw being connected to said draw rod via a screw-threaded connection whereby adjustment of said adjustment screw varies the vertical position of said toe clamp but the force of said spring means does not act on said adjustment screw.

Because the draw rod is supported from above and from below within the ski mounted housing, so that its vertical position remains constant, rotation of the threaded vertical adjustment screw results in the adjustment screw and the toe clamp moving upwardly and downwardly relative to the draw rod without the toe clamp being subjected to the forces of the release spring. The constructional arrangement is thus exceptionally simple because for manufacture and assembly solely two low-cost standard components, namely a smooth cylindrical pivot pin and an adjustment screw with one or other form of screw thread must be provided. No problems exist in arranging and housing these simple components in the toe clamp.

It is expecially advantageous if the pivot pin is axially undisplaceably fixed in the toe clamp and is vertically displaceable relative to the draw rod. For this purpose the pivot pin is usefully vertically slidably guided in a bore at the end of the draw rod. Thus, on assembly, the pivot pin solely needs to be tapped into the respective bores in the toe clamp and draw rod.

An exceptionally simple construction is realized if the pivot pin and the adjustment screw are arranged in the same hollow space within the toe clamp. This embodiment is also of especial advantage from the point of view of assembly.

An advantageous practical embodiment is achieved if the threaded connection between the adjustment screw and the draw rod includes an internally threaded intermediate member through which the correspondingly screw-threaded adjustment screw passes and which is restrained from rotational movement relative to the adjustment screw so that on rotation of the latter relative vertical movement takes places between the intermediate member and the toe clamp. The intermediate member is then fitted to the rear end of the draw rod so that it is vertically located thereby and so that rotation of the adjustment screw produces the desired vertical adjustment of the toe clamp.

Location of the intermediate member on the end of the draw rod is conveniently achieved by providing it with first and second projections which respectively engage above and below the draw rod. The location and guidance of the intermediate member on the end of the draw rod can be improved by arranging for the first and second projections to extend beyond the pivot pin and for the pivot pin to be a slide fit in vertically disposed guide bores in the projections.

The thought underlying the invention can be realized in even more simple fashion if the threads of the adjustment screw directly engage a threaded region at the end of the draw rod the threads of which are curved about an axis substantially coincident with the center of the pivot pin.

Finally it is basically also possible for the pivot pin to be axially fixed to the draw rod and axially displaceably guided in bores in the toe clamp. In an arrangement of this kind the threaded connection can be defined by cooperating screw threads on the adjustment screw and on the pivot pin.

Figure 2:
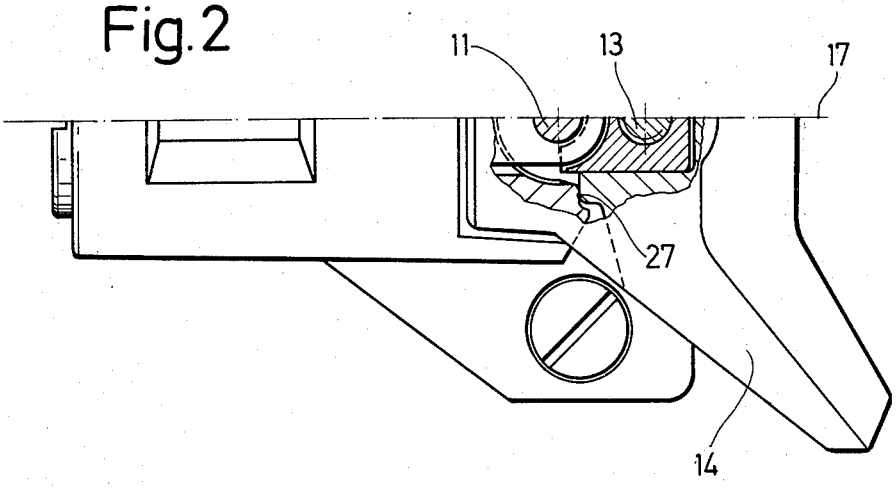
Figure 3:
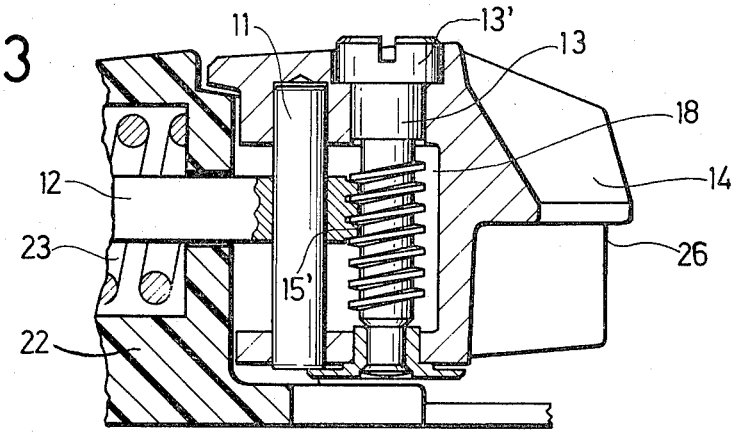
Figure 4:
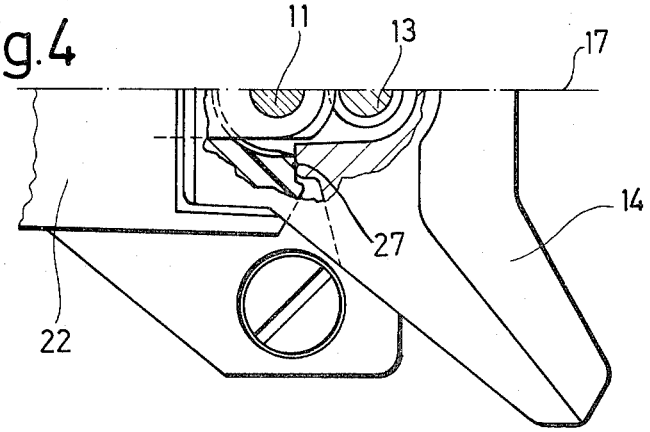
Figure 5:
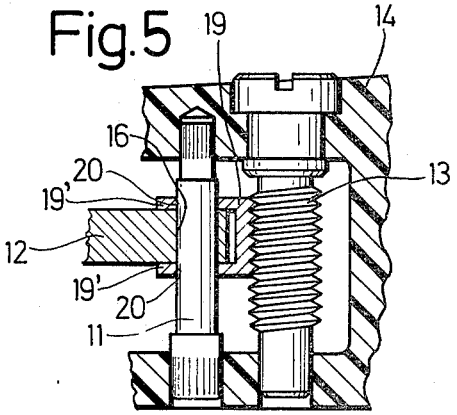
Figure 6:
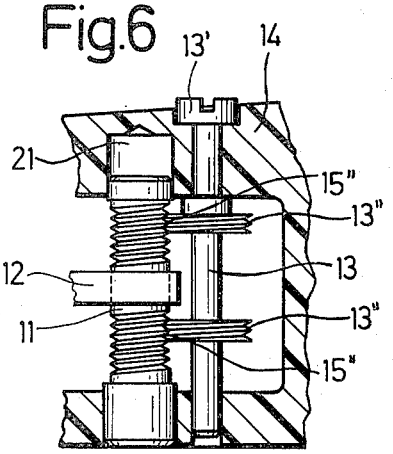

The invention will now be described in more detail by way of example only and with reference to the accompanying drawings in which are shown:

FIG. 1 a partially sectioned side view of a first embodiment of a safety toe unit in accordance with the present teaching, FIG. 2 a partially sectioned plan view of the subject of FIG. 1 taken to one side of the central longitudinal axis, FIG. 3 a partially sectioned side view similar to that of FIG. 1 but illustrating only the relevant part of a further embodiment of a safety toe unit, FIG. 4 a partially sectioned plan view of the subject of FIG. 3 taken to one side of the central longitudinal axis, FIG. 5 a partly sectioned side view similar to that of FIG. 1 but showing only the relevant detail of a third embodiment of a safety toe unit in accordance with the present teaching and FIG. 6 a partially sectioned side view similar to FIG. 5 but illustrating the detail of a fourth embodiment of a safety toe unit in accordance with the present teaching.

Referring firstly to FIG. 1 there can be seen a safety toe unit which is basically constituted by a binding housing 22, which is adapted to be fixedly secured to a ski, and a toe clamp 14 mounted on the housing and which is adapted to locate the front portion of a ski boot on the ski but which can deflect to either side of the ski to release the skier and ski boot from the ski in the event of a fall. A compression coil spring 23 and a draw rod 12 cooperate in a manner which will be later described in more detail to draw the toe clamp 14 against the binding housing 22 to establish contact between complementary pairs 27 of abutment features disposed to either side of the draw rod. These complementary abutment features define respective pivot axes about which the toe clamp can pivot to effect the aforementioned sideways release.

The detailed arrangement is as follows. The compression coil spring 23 is located within the housing 22 and engages at its forward end, i.e. the end remote from the toe clamp, an axially adjustable spring abutment 24 which sits on the forward end of the draw rod 12 which extends in the longitudinal direction of the ski through the binding housing 22. Screw threads (not shown) are provided in the customary manner between the front end of the draw rod and the spring abutment 24 so that rotation of the spring abutment increases the compression of the coil spring 23 and increases the force with which the toe clamp is drawn against the binding housing. The draw rod 12 extends through a guide aperture 25 towards the toe clamp 14. The guide aperture 25 in the binding housing 22 locates the draw rod 12 in a vertical direction but permits the sideways deflection of the draw rod 12 which necessarily occurs during sideways release.

The end of the draw rod 12 which projects beyond the binding housing 22 extends into a hollow space 18 within the toe clamp 14. The hollow space 18 is open only at the forward side of the toe clamp. The rear end of the draw rod is connected to the toe clamp 14 by a pivot pin 11 which extends vertically through a bore 16.

In the embodiment of FIGS. 1 and 2 the cylindrically shaped pivot pin 11 is rotatably journalled at both ends in corresponding matching bores of the toe clamp 14 and is vertically secured from below by means of a washer riveted to the end of the adjustment screw 13. The pivot pin 11 can, however, also be non-rotatably and non-displaceably journalled in the matching bores of the toe clamp 14 (e.g. in similar manner to the detailed arrangement of FIG. 5). The pivot pin 11 is, however, rotatably and vertically displaceably located within the bore 16 at the end of the draw rod 12.

The threaded adjustment screw 13 is rotatably located in the toe clamp 14 directly behind the pivot pin 11, i.e. in the direction towards the ski boot. The adjustment screw 13 is, however, secured by the riveted connection with the washer so that it cannot be displaced vertically relative to the toe clamp.

The head 13' of the adjustment screw 13 extends up to the upper surface of the toe clamp 14 so that it is externally accessible for adjustment purposes.

An intermediate member 19 is located on the adjustment screw 13 within the hollow space 18. The threaded portion of the adjustment screw 13 engages in an internally threaded bore 15 in the intermediate part 19. The side walls of the intermediate member 19 and of the hollow space 18 are closely fitting so that rotation of the adjustment screw 13 produces only vertical displacement of the intermediate member but not rotation thereof. As can be particularly clearly seen from FIG. 1 the intermediate member 19 is provided at its forward end with two fork-like, upper and lower, first and second projections 19' which engage respectively above and below the end of the draw rod 12. The intermediate member 19' is thus vertically located by the draw rod so that on rotation of the adjustment screw 13 the toe clamp 14 can be adjusted upwardly or downwardly to suit a desired size of ski boot. The vertical dimensions of the intermediate part 19 and of the hollow space 18 are chosen so that the desired range of vertical adjustment is available.

As can be clearly seen from FIG. 2 the pivot pin 11 and the adjustment screw 13 are arranged one behind the other along the central longitudinal axis 17 of the safety toe unit.

The force of the release spring 23 draws the toe clamp 14 against the binding housing 22 so as to produce contact of the complementary pairs of abutment surfaces 17 of which one pair is shown in FIG. 2. The two pairs of complementary abutment surfaces, which are respectively located one on each side of the draw rod 12, define two vertical pivot axes about which the toe clamp 14 can respectively pivot either to the left or to the right. The arrangement of the pivot axes is well known in the art and can be seen in detail from German Offenlegungsschrift 2 558 339.

The vertical adjustment of the toe clamp 14 relative to the ski or to the binding housing 22 takes place by rotating the adjustment screw 13 in one or other direction. During this adjustment the draw rod 12 and the intermediate member 19 remain in the vertical direction in the position which can be seen in FIG. 1 while the toe clamp 14 is moved upwardly or downwardly with the adjustment screw 13. The pivot pin 11 likewise takes part in the movement of the toe clamp 14 by sliding upwardly and downwardly within the guide formed by the bore 16.

In the embodiment of FIGS. 3 and 4 the intermediate member is dispensed with and the threads of the adjustment screw 13 directly engage a wedge profiled screw thread 15' provided at the end face of the draw rod 12. To allow pivotal movement of the toe clamp 14 about the pivot pin 11 it is necessary for the threads 15' to be of arcuate form with the center of the arc substantially coincident with the central longitudinal axis of the pivot pin. In the embodiment of FIGS. 3 and 4 the intermediate member is no longer required which is e.g. advantageous in connection with ski bindings for children.

In the embodiment shown in FIG. 5, which includes an intermediate member 19, the fork-like ends or projections 19' of the intermediate member project forwardly beyond the pivot pin 11. Vertically disposed bores 20 are provided in the projections 19' of the intermediate member 19 and form guides for receiving the pivot pin 11 which is also able to slide vertically within the vertical bore 16 at the end of the draw rod 12.

In the embodiment of FIG. 6 the pivot pin 11 is fixed in the end of the draw rod 12 but is, however, rotatably and vertically displaceably arranged in the bores 21 within the toe clamp 14. In analogous manner to the previous embodiments the adjustment screw 13 can either cooperate with the end of the draw rod 12 or, as shown in FIG. 6, with screw threads provided on the pivot pin. In the arrangement of FIG. 6 the threaded parts 13" provided on the adjustment screw 13 extend up to and engage the counter threads 15" provided on the pivot pin 11. In this embodiment rotation of the adjustment screw 13 also results in a vertical adjustment of the toe clamp 14 without the vertical adjustment mechanism being disadvantageously influenced by the forces of the release spring 23.

We claim:

1. A safety toe unit for a ski binding comprising a binding housing for fastening to a ski, a toe clamp disposed at the rear of the housing and adapted to locate the toe portion of a ski boot, a vertically extending freely rotatable but axially located adjustment screw carried by said toe clamp for adjusting the vertical height thereof, spring means adapted to draw the toe clamp against the housing via a draw rod disposed within the housing and extending through an opening therein said opening being sized to locate the draw rod in the vertical direction but to permit sideways movement thereof, a first pair of complementary abutment surfaces provided between the toe clamp and the housing and located to one side of the draw rod, a second pair of complementary abutment surfaces provided between the toe clamp and the housing and located to the other side of the draw rod, said first and second pairs of complementary abutment surfaces defining respective first and second pivot axes respectively enabling sideways pivotal movement of the sole clamp to a respective side of a housing with simultaneous separation of the pair of complementary abutment surfaces defining the other of said pivot axes and simultaneous movement of said draw rod, there being further provided a pivot pin arranged parallel to said adjustment screw and located in bores in the toe clamp for directly pivotally connecting said toe clamp to said draw rod, said pivot pin being vertically displaceable relative to one of said toe clamp and said draw bar, and said adjustment screw being connected to said draw rod via a screw-threaded connection whereby adjustment of said adjustment screw varies the vertical position of said toe clamp but the force of said spring means does not act on said adjustment screw.

2. A ski safety binding in accordance with claim 1 and wherein said pivot pin and said adjustment screw are arranged spaced apart by a small distance one behind the other along the central longitudinal axis of said safety toe unit.

3. A safety toe unit according to claim 1 and wherein said pivot pin is vertically displaceable relative to said draw rod but is axially located in said toe clamp.

4. A safety toe unit according to claim 3 and wherein said pivot pin is guided for vertical sliding movement in a bore at the end of said draw rod.

5. A safety toe unit according to claim 1 and wherein said pivot pin and said adjustment screw are arranged within a hollow space inside said toe clamp.

6. A ski safety binding according to claim 1 and wherein the means defining said threaded connection comprises an internally threaded intermediate member cooperable with said threaded adjustment screw, means securing the intermediate member against rotation relative to said toe clamp whereby to produce relative vertical motion between said intermediate member and said sole clamp on rotation of said adjustment screw and means cooperable with said draw rod to locate said intermediate member vertically with respect to said housing.

7. A safety toe unit in accordance with claim 6 and in which side surface means of said intermediate member engage corresponding surface means of a hollow space within said toe clamp whereby to define said means preventing relative rotation between said intermediate member and said toe clamp.

8. A safety toe unit according to claim 6 and in which said means cooperating with said draw rod to prevent vertical movement of said intermediate member relative to said housing comprises first and second projections engaging respectively above and below said draw rod.

9. A safety toe unit in accordance with claim 8 and in which said first and second projections extend along said draw rod beyond said pivot pin and said pivot pin passes through respective vertically extending bores in said first and second projections, said bores being a slide fit on said pivot pin.

10. A safety toe unit in accordance with claim 1 and wherein said threaded connection is defined by the threads of said adjustment screw directly engaging a corresponding threaded region at the end of said draw rod, the threads of said correspondingly threaded region extending around an axis substantially coincident with the axis of said pivot pin whereby to permit a pivotal movement of said toe clamp about said axis.

11. A safety toe unit in accordance with claim 1 and in which said pivot pin is axially undisplaceably secured at said draw rod and is axially displaceably guided in said bores of said toe clamp.

12. A safety toe unit in accordance with claim 11 and in which said threaded connection comprises cooperating threaded regions provided on said pivot pin and said threaded adjustment screw.

* * * * *